US010883332B2

(12) United States Patent
Zhao et al.

(10) Patent No.: US 10,883,332 B2
(45) Date of Patent: Jan. 5, 2021

(54) ELECTROACTIVE POLYMER-BASED DOWNHOLE SEAL

(71) Applicants: Lei Zhao, Houston, TX (US); Zhiyue Xu, Cypress, TX (US); Guijun Deng, The Woodlands, TX (US)

(72) Inventors: Lei Zhao, Houston, TX (US); Zhiyue Xu, Cypress, TX (US); Guijun Deng, The Woodlands, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 37 days.

(21) Appl. No.: 16/282,399

(22) Filed: Feb. 22, 2019

(65) Prior Publication Data

US 2019/0264529 A1 Aug. 29, 2019

Related U.S. Application Data

(60) Provisional application No. 62/634,528, filed on Feb. 23, 2018.

(51) Int. Cl.
*E21B 33/12* (2006.01)
*E21B 33/13* (2006.01)

(52) U.S. Cl.
CPC ..... *E21B 33/1208* (2013.01); *E21B 33/13* (2013.01); *E21B 2200/01* (2020.05)

(58) Field of Classification Search
CPC ..... E21B 33/00; E21B 33/13; E21B 33/1208; E21B 33/134; E21B 2200/01
See application file for complete search history.

(56) References Cited

U.S. PATENT DOCUMENTS

| | | | | |
|---|---|---|---|---|
| 6,867,533 | B1 | 3/2005 | Su et al. | |
| 6,891,317 | B2 * | 5/2005 | Pei | A61M 5/142 310/328 |
| 7,690,437 | B2 | 4/2010 | Guillot et al. | |
| 7,806,193 | B2 | 10/2010 | Berzin et al. | |
| 2008/0149348 | A1 | 6/2008 | Difoggio et al. | |
| 2009/0000793 | A1 * | 1/2009 | Guillot | E21B 17/1028 166/380 |
| 2009/0139707 | A1 * | 6/2009 | Berzin | E21B 33/1208 166/118 |
| 2015/0091254 | A1 | 4/2015 | Krutz et al. | |

FOREIGN PATENT DOCUMENTS

WO 2018007441 A1 1/2018

OTHER PUBLICATIONS

International Search Report for International Application No. PCT/US2019/019175, International Filing Date Feb. 22, 2019, dated Jun. 5, 2019, 3 pages.
Written Opinion for International Application No. PCT/US2019/019175, International Filing Date Feb. 22, 2019, dated Jun. 5, 2019, 6 pages.
Zhao, et al.; "An application review of dielectric electroactive polymer actuators in acoustics and vibration control"; Journal of Physics: Conference Series, vol. 744, No. 1, 2016 J. Phys.: Conf. Ser. 744 012162; 9 pages.

* cited by examiner

*Primary Examiner* — David Carroll
(74) *Attorney, Agent, or Firm* — Cantor Colburn LLP

(57) ABSTRACT

A downhole seal includes a field responsive shape changeable material configured as a layer having a first surface and a second surface, a first field generating electrode disposed in operable communication with the first surface, and a second field generating electrode disposed in operable communication with the second surface.

25 Claims, 5 Drawing Sheets

ELECTROACTIVE POLYMER-BASED DOWNHOLE SEAL

CROSS REFERENCE TO RELATED APPLICATIONS

This application claims the benefit of an earlier filing date from U.S. Provisional Application Ser. No. 62/634,528, filed Feb. 23, 2018, the entire disclosure of which is incorporated herein by reference.

BACKGROUND

In the resource recovery industry seals of various types are often utilized for many different types of operations. Generally speaking, each type of seal is of different dimension and requires a dedicated setting tool. The result is a wide variety and large number of tools required to keep on hand for various operations. Add to this that each manufacturer also has its own paradigm and the number of tools to maintain on hand increases substantially. Cost and logistic efficiency are always important to businesses and perhaps even more so in the resource recovery industry simply because the locations for recovery are widespread and generally difficult to access. Reducing the number of different required tools would improve both cost and logistics and would be well received by the art.

SUMMARY

A downhole seal includes a field responsive shape changeable material configured as a layer having a first surface and a second surface, a first field generating electrode disposed in operable communication with the first surface, a second field generating electrode disposed in operable communication with the second surface.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
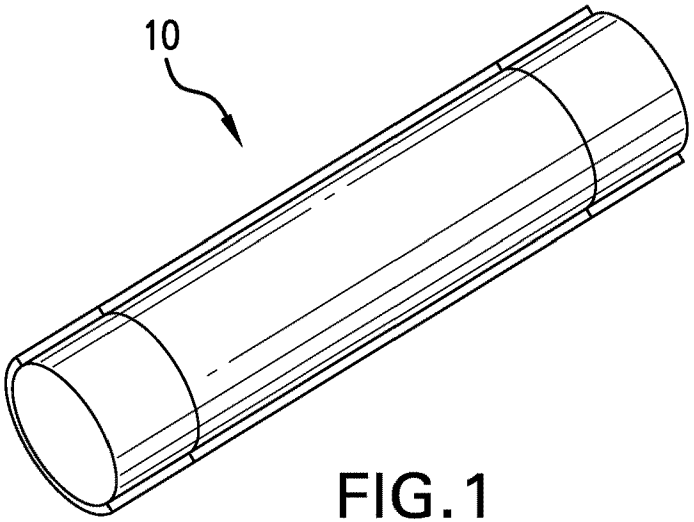
FIG. 1 is a schematic perspective view of a downhole seal as disclosed herein.

Referring to FIG. 1, one of ordinary skill in the art will recognize the perspective view of a seal 10 such as a packer, bridge plug, etc. The seal is intended to represent any type of seal for a cased well or an open hole well that either interrupts an annular space or interrupts an entire tubular fluid path such as in the case of an abandonment plug or similar. One of skill will also appreciate from the previous sentence that the distinction revolves around whether or not a hollow is formed in the relative axial center of the seal 10 or if this area is closed.

Figure 2:
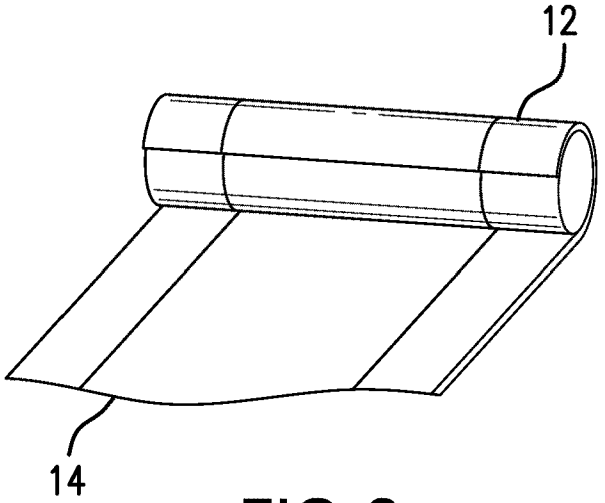
FIG. 2 is a schematic view of a part of an operation to make the seal as claimed herein.

Referring to FIG. 2, it will be appreciated that the seal 10 is represented in a state of manufacture and that the particular illustration includes a mandrel 12. It is considered that most iterations will include a mandrel simply due to ease of construction and later use but is it to be appreciated that the teaching hereof may also be employed without a mandrel 12. Specifically, the material that will be discussed more hereunder may be used on its own to create either a solid plug or a hollow center plug that will close off an annulus, if desired. In FIG. 2, the skilled artisan will appreciate that a material 14 is being wrapped onto the mandrel 12. In embodiments, the number of times the material 14 is wrapped will vary. Some embodiments will form a single wrap of material 14 while other embodiments will include a spiral of material 14 resulting in several layers of wrap about the mandrel 12 or about a hollow center or, by starting the wrap tightly (to form an essentially solid spiral of material 14), several wraps about the material 14 itself.

The material 14 is of a type that reacts to an applied field, such as an electric or magnetic field. In an embodiment of the present teaching, the material 14 is configured and positioned to react to an applied field (illustrated as an electric field applying a voltage to the material 14) to lengthen and thin itself. In such a condition, the seal 10 is easier to run in the hole. As so configured, the material 14 will resume a shape, after removal of the filed that is shorter and thicker (the shape it had prior to the application of the field). This is beneficial not only because it facilitates running the seal 10 to target but also because, by definition, the requirement for the filed to be applied in order to run the seal 10 and removed for setting the seal 10 means that no particular impetus need be maintained to keep the seal 10 set. The seal 10 sets and stays set without maintenance of any field thereon.

Figure 4:
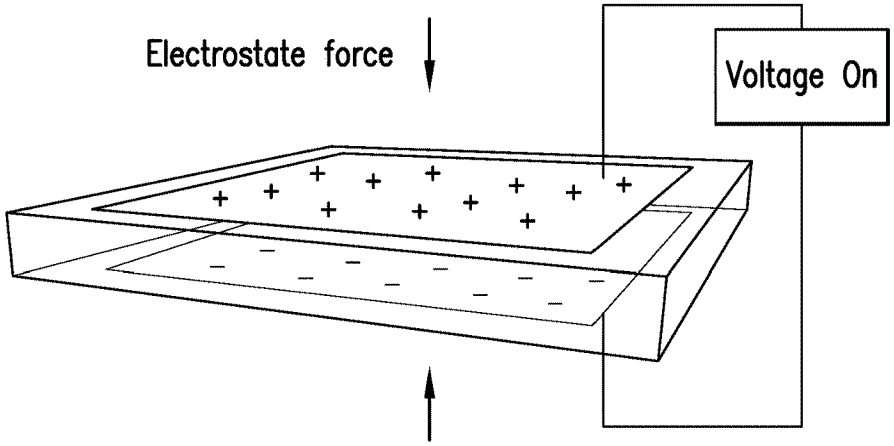
FIG. 4 is a schematic perspective view of an electroactive polymer after application of an electric field thereto.
Figure 3:
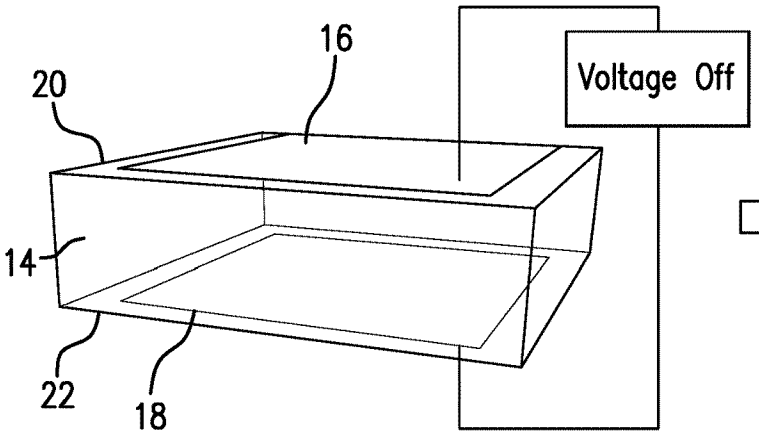
FIG. 3 is a schematic perspective view of an electroactive polymer before application of an electric field thereto.

Referring to FIGS. 3 and 4, the material 14 is more specifically described. The material may be an electroactive polymer material or an electroactive composite which will react as shown by viewing the two figures seriatim. It is the case that the thicker the electroactive material, the greater the voltage needed to make it react. Due to conditions downhole including distance to a power source, a very high voltage is a seemingly insurmountable obstacle to creating a seal as disclosed herein. The inventors hereof have however determined that electrical energy requirements can be reduced proportionally to a volume of the material 14 between the electrodes. Hence, thinner sections of material 14 between electrodes will require less electrical energy to be activated. Material that can then be layered to the desired overall dimensions of the seal 10. Field requirements for the thinner material are less and so voltage required is less and yet the overall change in dimensions can be preserved because the change among the layers is additive.

Figure 5:
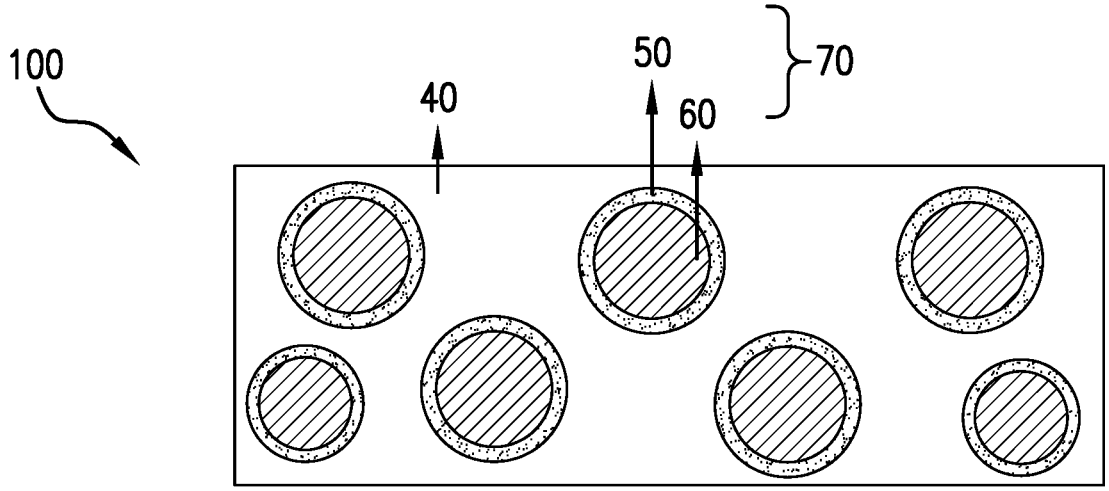
FIG. 5 is a schematic illustration of an electroactive composite.
Figure 6:
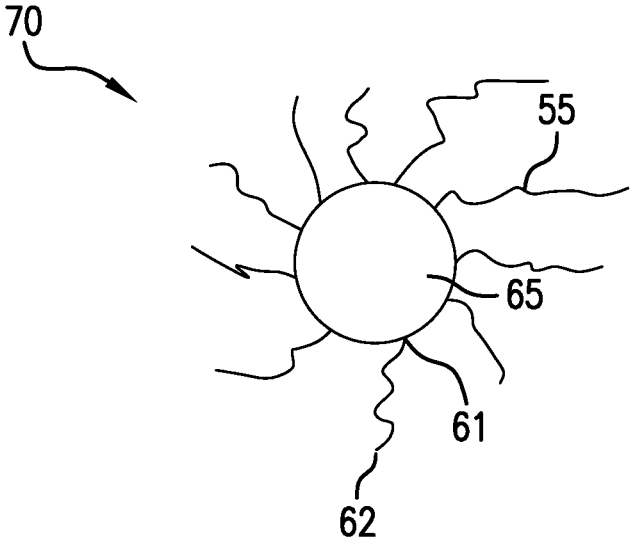
FIG. 6 is a schematic illustration of a surface treated electroactive enhancement filler.

Using an electroactive composite can also reduce the electrical voltage required to generate the target shape or dimensional change of material 14 for downhole seal applications. Referring to FIGS. 5 and 6, electroactive composite 100 includes a polymer matrix 40 and a surface treated electroactive enhancement filler dispersed in the polymer matrix 40.

The polymer matrix can include fluoro elastomers, which are electroactive and corrosion resistant. The polymer matrix can be present in an amount of about 10 wt % to about 90 wt % or about 40 wt % to about 70 wt % based on the total weight of the electroactive composite.

The surface treated electroactive enhancement filler 70 has a core 60 and a surface coating 50. Examples of the filler include Ni, Cu, $TiO_2$, $PbTiO_3$, $BaTiO_3$, or a combination comprising at least one of the foregoing. The filler can be present in the form of powders. In an embodiment, the filler comprises particles having a size of about 10 nm to about 100 μm. The filler can have a higher surface energy than the polymer matrix. Without surface treatment, the filler tends to agglomerate when dispersed in the polymer matrix. Without wishing to be bound by theory, it is believed that the conglomeration of the filler could cause electrical breakdown, limiting the maximum voltage that could be applied on material 14. It has been found that organic molecules 55 such as ligands and surfactants can be coated on filler 65 before the filler is dispersed in the polymer matrix. One end of these organic molecules 61 is polarized and can bond to the surface of the filler 65 forming a surface coating 50. The coating functions as an insulting layer keeping the filler particles apart. The other end 62 of the organic molecules is not polarized, and has strong affinity to the polymer matrix, thus allowing the surface treated enhancement filler 70 to be uniformly dispersed in the polymer matrix. The surface treated enhancement filler increases the dielectric constant of the polymer matrix. Based on the electroactive performance equation, $\sigma M=\varepsilon\varepsilon_0 E^2$ where $\sigma_M$ is the strain of an electroactive material under a voltage, is dielectric constant, and H is electrical intensity, the increased dielectric constant lowers the voltage required to change the dimension or shape of material 14.

Figure 7:
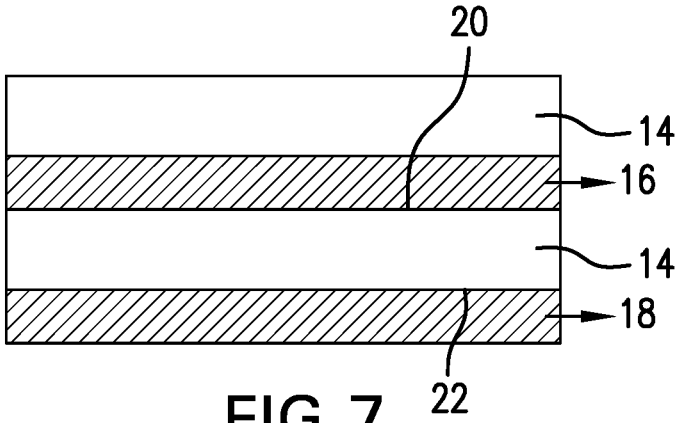
FIG. 7 is a schematic illustration of an electroactive polymer film with electrodes.

Referring to FIG. 7, the material 14 and electrodes 16 and 18 are in operable communication with one surface or the other (not both) of the material 14 so for example, a first electrode 16, is in operable communication with a first surface 20 of the material 14 and a second electrode 18 is in operable communication with a second surface 22 of the material 14. The electrodes 16 and 18 will be insulated from the opposite surfaces 20 and 22. In some embodiments, the insulation may be inert to the system and in others, the insulation may be an additional layer of electroactive material, which will then also react to energization and change its shape too, adding to the total effect of the seal 10.

In addition to the dimensional considerations of the material 14 discussed above, it is also prudent to provide a transformer in close proximity to the seal during deployment and another transformer at a power source so that greater flexibility of voltage versus current being transported through the borehole is achieved. This is beneficial for regulatory issues and efficiency relative to conductor sizes required.

Figure 8:
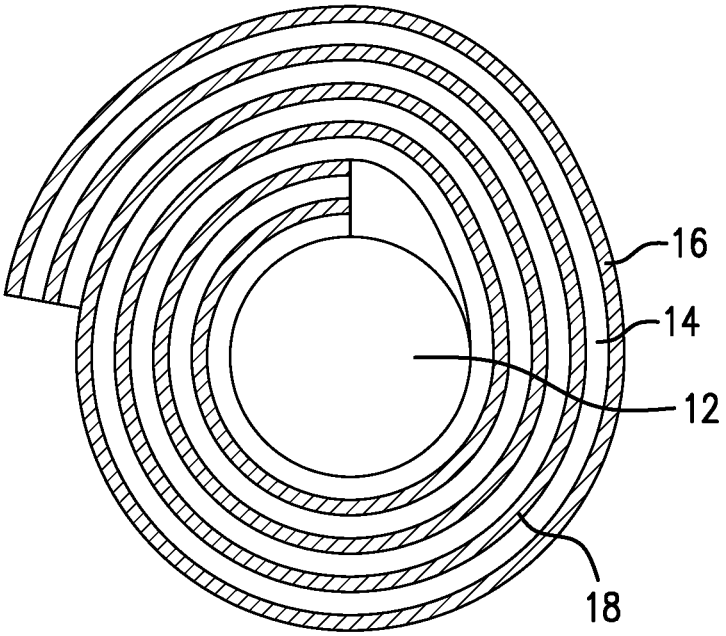
FIG. 8 illustrates wrapping the electroactive polymer film shown in FIG. 7 on a mandrel to make a seal.
Figure 10:
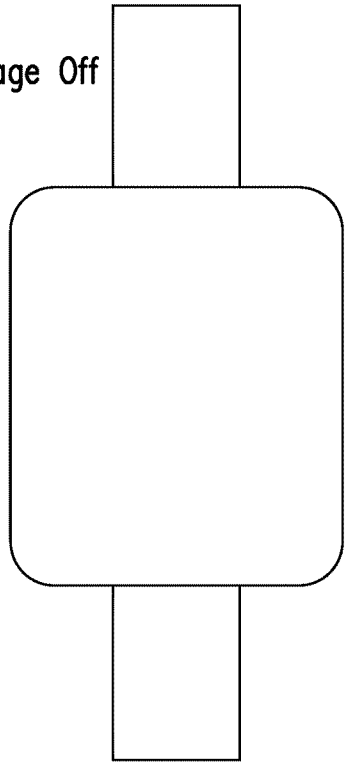
FIG. 10 is a representation of the same seal as represented in FIG. 6 but with the field removed therefrom.
Figure 9:
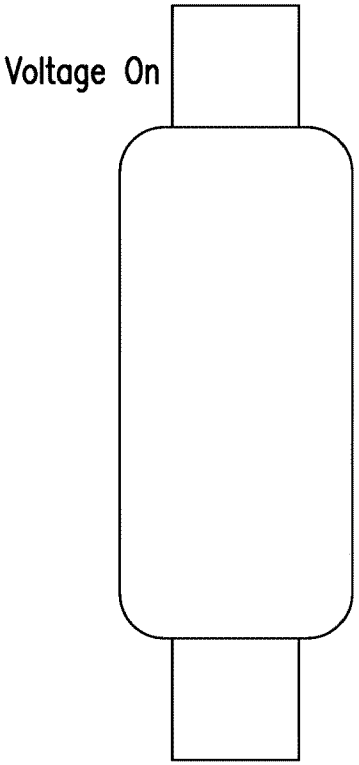
FIG. 9 is a representation of a seal as disclosed herein with a field applied thereto.

Referring to FIG. 8, once the material 14 is wrapped either about itself of about a mandrel 12 with the electrodes disposed as described above, the seal 10 is ready for deployment. The field is energized resulting in a thinning and elongation of the seal 10 as illustrated in FIG. 9. This condition facilitates deployment into the borehole since it is easier to run thinner bodies with more space around them than thicker bodies approaching a drift diameter of the tubular form through which the seal 10 will be deployed. Then upon reaching the desired location to set the seal 10, the field will be removed and the seal 10 will regain its former dimensions as illustrated in FIG. 10. It will be appreciated that such movement will cause a mechanical pressure against a tubular form whose dimensions are within the bounds of the fully expanded seal 10. A seal will thus be formed in the tubular at this point. Since the seal 10 utilizes the field to reduce its overall diametric dimension rather than to increase its diametric dimension, the seal 10 is inherently safe since it requires no input of power to maintain its set position.

Figure 11:
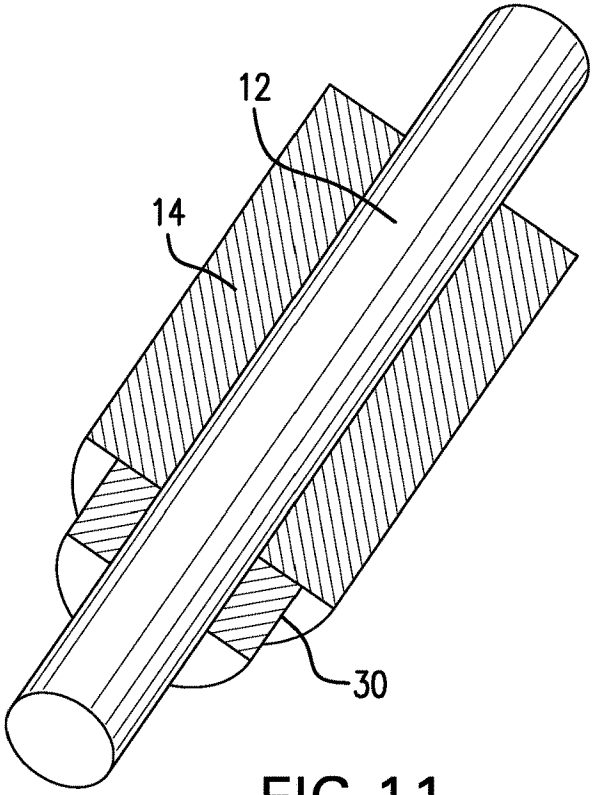
FIG. 11 is a representation of the seal with a backup.

In some embodiments, referring to FIG. 11, a backup 30 is also employed. The mandrel 12 is fitted in such embodiments with wickers or the like that interact with the backup 30 in ways known to the art such that the backup 30 may move in one direction but not in the other. In this case, the backup will be fit to the mandrel 12 in a position that provides space for the length increase during application of the field to the material and configured to move with the material 14 during its shape change following removal of the field. In embodiments, the backup will be bonded to the material to effect this desired movement. The backup 30 will ratchet over wickers 32 or similar during movement with the material 14 after removal of the field and hence will prevent any movement in the opposite direction thereafter. The backup will also help prevent extrusion of the seal over time.

Set forth below are some embodiments of the foregoing disclosure:

Embodiment 1

A downhole seal including a field responsive shape changeable material configured as a layer having a first surface and a second surface, a first field generating electrode disposed in operable communication with the first surface, and a second field generating electrode disposed in operable communication with the second surface.

Embodiment 2

The seal as in any prior embodiment further including a mechanical backup.

Embodiment 3

The seal as in any prior embodiment wherein the mechanical backup is a body lock ring.

Embodiment 4

The seal as in any prior embodiment wherein the body lock ring is configured to move automatically with the field responsive shape changeable material in a single direction.

Embodiment 5

The seal as in any prior embodiment wherein the seal further comprises a mandrel upon which the material is mounted.

Embodiment 6

The seal as in any prior embodiment wherein the mandrel is solid.

Embodiment 7

The seal as in any prior embodiment wherein the mandrel is hollow.

Embodiment 8

The seal as in any prior embodiment wherein the first electrode and the second electrode are insulated from operable communication with the opposite of the first and second surfaces.

Embodiment 9

The seal as in any prior embodiment wherein the seal further comprises an additional layer of material disposed to isolate one of the first and second electrodes from the opposite of the first and second surfaces.

Embodiment 10

The seal as in any prior embodiment wherein the additional layer of material is an electroactive polymer or an electroactive polymer composite.

Embodiment 11

The seal as in any prior embodiment wherein the first field generating electrode is of a first polarity and the second field generating electrode is of an opposite polarity to the first polarity.

Embodiment 12

The seal as in any prior embodiment wherein the field is an electric field.

Embodiment 13

The seal as in any prior embodiment, wherein the field responsive shape changeable material changes shape upon energization of the first and second electrodes.

Embodiment 14

The seal as in any prior embodiment wherein the field responsive shape changeable material is an electroactive polymer or an electroactive polymer composite.

Embodiment 15

The seal as in any prior embodiment wherein the field responsive shape changeable material is an electroactive polymer composite, which comprises a surface treated electroactive enhancement filler dispersed in a polymer matrix.

Embodiment 16

The seal as in any prior embodiment wherein the surface treated electroactive enhancement filler comprises an inorganic core and a surface coating disposed on the inorganic core.

Embodiment 17

The seal as in any prior embodiment wherein the seal is configured in a tubular shape.

Embodiment 18

The seal as in any prior embodiment wherein the seal is configured in a spiral shape.

Embodiment 19

The seal as in any prior embodiment wherein the spiral includes a hollow defined by the material.

Embodiment 20

A method for sealing a downhole structure including energizing the first and second electrodes of the seal as in any prior embodiment, changing shape of the seal as a result of the energizing, running the seal to a target location, de-energizing the first and second electrodes, and reversing the change of shape of the seal as a result of the de-energizing.

Embodiment 21

The method as in any prior embodiment wherein the changing shape is elongating and thinning the seal.

Embodiment 22

The method as in any prior embodiment wherein the reversing the change of shape is shortening and thickening of the seal.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A downhole seal comprising:

a field responsive shape changeable material configured as a layer having a first surface and a second surface, a first field generating electrode disposed in operable communication with the first surface, and a second field generating electrode disposed in operable communication with the second surface, wherein the field responsive shape changeable material is an electroactive polymer composite, which comprises a surface treated electroactive enhancement filler dispersed in a polymer matrix.

2. The seal of claim 1, further including a mechanical backup.

3. The seal of claim 2, wherein the mechanical backup is a body lock ring.

4. The seal of claim 1, wherein the seal further comprises a mandrel upon which the field responsive shape changeable material is mounted.

5. The seal of claim 1, wherein the first electrode and the second electrode are insulated from operable communication with the opposite of the first and second surfaces.

6. The seal of claim 1, further comprising an additional layer of material disposed to isolate one of the first and second electrodes from the opposite of the first and second surfaces.

7. The seal of claim 6, wherein the additional layer of material is an electroactive polymer or an electroactive polymer composite.

8. The seal of claim 1, wherein the first field generating electrode is of a first polarity; and the second field generating electrode is of an opposite polarity to the first polarity.

9. The seal of claim 1, wherein the field is an electric field.

10. The seal of claim 1, wherein the field responsive shape changeable material changes shape upon energization of the first and second electrodes.

11. The seal of claim 1, wherein the field responsive shape changeable material is an electroactive polymer or an electroactive polymer composite.

12. The seal of claim 1, wherein the surface treated electroactive enhancement filler comprises an inorganic core and a surface coating disposed on the inorganic core.

13. The seal of claim 1, wherein the seal is configured in a tubular shape.

14. The seal of claim 1, wherein the seal is configured in a spiral shape.

15. The seal of claim 14, wherein the spiral shape includes a hollow defined by the filed responsive shape changeable material.

16. A method for sealing a downhole structure, the method comprising:

energizing the first and second electrodes of the seal of claim 1, changing shape of the seal as a result of the energizing, running the seal to a target location, de-energizing the first and second electrodes, and reversing the change of shape of the seal as a result of the de-energizing.

17. The method of claim 16, wherein the changing shape is elongating and thinning the seal.

18. The method of claim 16, wherein the reversing the change of shape is shortening and thickening of the seal.

19. A downhole seal comprising:

a field responsive shape changeable material configured as a layer having a first surface and a second surface, a first field generating electrode disposed in operable communication with the first surface, a second field generating electrode disposed in operable communication with the second surface, and a mechanical backup which is a body lock ring, wherein the body lock ring is configured to move automatically with the field responsive shape changeable material in a single direction.

20. The seal of claim 19, wherein the field responsive shape changeable material is an electroactive polymer composite, which comprises a surface treated electroactive enhancement filler dispersed in a polymer matrix.

21. The seal of claim 19, wherein the seal further comprises a mandrel upon which the field responsive shape changeable material is mounted.

22. The seal of claim 19, wherein the first electrode and the second electrode are insulated from operable communication with the opposite of the first and second surfaces.

23. The seal of claim 19, further comprising an additional layer of material disposed to isolate one of the first and second electrodes from the opposite of the first and second surfaces, wherein the additional layer of material is an electroactive polymer or an electroactive polymer composite.

24. The seal of claim 19, wherein the first field generating electrode is of a first polarity; and the second field generating electrode is of an opposite polarity to the first polarity.

25. A method for sealing a downhole structure, the method comprising:

energizing the first and second electrodes of the seal of claim 19, changing shape of the seal as a result of the energizing, running the seal to a target location, de-energizing the first and second electrodes, and reversing the change of shape of the seal as a result of the de-energizing.

* * * * *